United States Patent [19]

Mizusawa et al.

[11] Patent Number: 4,982,467

[45] Date of Patent: Jan. 8, 1991

[54] RINSE RELEASE LAUNDRY ADDITIVE AND DISPENSER

[75] Inventors: Eugene A. Mizusawa, Castro Valley; Donald J. Paone, Hayward; Tracey L. Casella, Martinez; Dorothy L. Flores, Livermore; Clement K. Choy, Walnut Creek; Jan Gerritsen, Walnut Creek, all of Calif.

[73] Assignee: The Clorox Company, Oakland, Calif.

[21] Appl. No.: 436,572

[22] Filed: May 11, 1989

Related U.S. Application Data

[62] Division of Ser. No. 193,310, May 11, 1988, Pat. No. 4,882,917.

[51] Int. Cl.[5] ..... D06F 39/02

[52] U.S. Cl. ..... 8/158; 8/159

[58] Field of Search ..... 68/17 A; 252/8.6, 8.8, 252/90, 91; 8/158, 159

[56] References Cited

U.S. PATENT DOCUMENTS

| | | | |
|---|---|---|---|
| T993,001 | 4/1980 | McCarthy | 68/17 R |
| 3,330,135 | 7/1967 | Douglas | 68/18 |
| 3,442,692 | 5/1969 | Gaiser . | |
| 3,481,163 | 12/1969 | Bocham et al. | 68/4 |
| 3,575,021 | 4/1971 | Bochan | 68/17 |
| 3,596,480 | 8/1971 | Douglas | 68/17 A |
| 3,620,054 | 12/1971 | Drews et al. | 68/17 A |
| 3,632,396 | 1/1972 | Perez-Zamora . | |
| 3,670,530 | 6/1972 | Filipak | 68/17 A |
| 3,686,025 | 8/1972 | Morton . | |
| 3,698,095 | 10/1972 | Grand et al. | 34/9 |
| 3,699,785 | 10/1972 | Waugh | 68/17 A |
| 3,736,773 | 6/1973 | Waugh | 68/17 A |
| 3,757,544 | 9/1973 | Olthuis | 68/17 A |
| 3,888,391 | 6/1975 | Merz | 222/52 |
| 3,944,694 | 3/1976 | McQuery | 428/131 |
| 3,947,971 | 4/1976 | Bauer | 34/60 |
| 4,022,938 | 5/1977 | Zaki et al. | 427/242 |
| 4,026,131 | 5/1977 | Dugger et al. | 68/17 A |
| 4,049,858 | 9/1977 | Murphy | 428/136 |
| 4,073,996 | 2/1978 | Bedenk et al. | 428/274 |
| 4,095,946 | 6/1978 | Jones et al. | 8/137 |
| 4,096,072 | 6/1978 | Brock et al. | 252/8.8 |
| 4,098,937 | 4/1978 | Mizuno et al. | 428/68 |
| 4,103,047 | 7/1978 | Zaki et al. | 427/242 |
| 4,113,630 | 9/1978 | Hagner | 252/8.6 |
| 4,118,525 | 10/1978 | Jones | 427/242 |
| 4,118,957 | 10/1978 | Marcussen | 68/17 A |
| 4,154,069 | 5/1979 | Lipfert et al. | 68/17 A |
| 4,170,678 | 10/1979 | Urfer et al. | 428/124 |
| 4,186,573 | 2/1980 | Brenner et al. | 68/12 R |
| 4,186,574 | 2/1980 | Sundstrom | 68/17 A |
| 4,234,627 | 11/1980 | Schilling | 427/242 |
| 4,240,277 | 12/1980 | Manthei | 68/17 A |
| 4,260,054 | 4/1981 | Bory et al. | 206/0.5 |
| 4,379,515 | 4/1983 | Towsend | 222/52 |
| 4,389,448 | 6/1983 | Green | 428/195 |
| 4,420,951 | 12/1983 | Clearman et al. | 68/17 R |
| 4,423,105 | 12/1983 | Dillarstone et al. | 428/198 |
| 4,478,059 | 10/1984 | Yates | 68/17 A |
| 4,656,844 | 4/1987 | Mulder et al. | 68/17 A |

FOREIGN PATENT DOCUMENTS 2157718 10/1985 United Kingdom .

*Primary Examiner*—Philip R. Coe

*Attorney, Agent, or Firm*—Michael J. Mazza; Joel J. Hayashida; Stephen M. Westbrook

[57] ABSTRACT

A wash additive combination is provided which is loaded into a washing machine at the start of a wash cycle, and which releases a wash additive, such as a fabric softener, into the rinse solution. The combination comprises a wash additive packet of a foam substrate material having a first and a second stable conformation of differing surface area, and a wash additive deposited thereon. A dispenser is provided for mounting atop a washing machine agitator, and into which the packet may be releasably placed, after arranging the packet in its lesser surface area conformation. The packet is retained by the dispenser during initial phases of the wash cycle, and ejected during the spin phase, whereupon it regains its greater surface area conformation for rapid and complete dispersion of active. Embodiments are provided for dual, sequential release of active in the rinse and the dryer.

3 Claims, 3 Drawing Sheets

RINSE RELEASE LAUNDRY ADDITIVE AND DISPENSER

This is a division of application Ser. No. 193,310, filed May 11, 1988, and now U.S. Pat. No. 4,882,917.

BACKGROUND OF THE INVENTION

1. Field of the Invention

The present invention relates to fabric conditioning articles for washing machines, and more particularly to rinse-released fabric conditioning articles and centrifugally-actuated additive dispensers therefor.

2. Description of Related Art

Paralleling the quest for improved efficacy of laundry products is the quest for improved convenience of use of such products. One approach to the latter is the multi-use approach wherein two or more laundry additives are included on a single delivery substrate. As used herein, "laundry additive" refers to any composition added to enhance the cleanliness, sanitation or aesthetics of fabrics, and includes, but is not limited to detergents, whiteners, fabric softeners, antistat agents, bleaches, bleach activators, anti-redeposition agents, enzymes and mixtures of the foregoing. The multi-use approach contemplates depositing two or more additives targeted at different phases of a laundry cycle, e.g. detergent plus a fabric softener,.upon or within a delivery substrate. The substrate is added to the washer at the start of the laundry cycle, and is designed to dispense the additive at the stage of the laundry cycle where the additive is most effective. Also as used herein, "laundry cycle" refers to the overall laundering process including washing and drying. "Wash cycle" will be used to specifically refer to the phase of the laundry cycle which occurs in the washing machine, and comprises at least a wash phase, a rinse phase and a spin phase. There are several drawbacks associated with multi-use compositions of the art. Typically, delivery of each additive does not occur exactly at the stage of the laundry cycle where its use is most efficient. Multi-use packages are often inefficient owing to their fixed proportions of the various additives. The consumer thus cannot vary the amount of a particular additive without altering the amount of the remaining additives In many cases, delivery of a particular additive does not occur, or incompletely occurs, when intended. This severely reduces performance of the additive. Some additives can interact with their co-additives, also severely reducing their performance. Most multi-use additives include the additive, e.g. fabric softener, with the detergent composition, and such detergents usually hamper the performance of such softeners The detergent/softener compositions are thus relatively easy to use, but do not work well.

Another approach to obtaining the convenience of multi-use with the effectiveness and flexibility of single-use additives is to provide a means for dispensing the additive at the desired points in the laundry cycle. Typically however, such a dispenser is a mechanical device built into the washing machine, and has a limited capability for dispensing additives. Many of these dispensers are suited to dispense only liquid additives and usually are manufactured by the appliance manufacturer to fit only certain washing machines also manufactured thereby. A number of patent references describe dispensers which use centrifugal force developed by a washing machine during a spin phase to effect release of an additive which is most efficacious in the rinse. The centrifugal dispensers of the art described in such references appear to fall into two categories: (a) passive dispensers with no moving parts which rely entirely on centrifugal force to release the additive; and (b), active dispensers which utilize centrifugal force to effect a change in configuration of the dispenser, causing the release of the additive.

Generally, the prior art dispensers of the first type are suited to dispense only liquid additives, which are effective only if delivered in the rinse. The second class of prior art dispensers are often complex, and/or are limited in their application to a small number of washing machine agitators The liquid additives suffer the disadvantage of being inconvenient, and often messy to use, while the mechanical dispensers necessary to dispense the liquid additive generally must be provided by the manufacturer with the washing machine, and cannot be retrofitted.

The first category of prior art dispensers describe, in general, a two-chamber dispenser which is mounted on top of an agitator. An inner chamber has outwardly sloping walls and is initially filled with the additive. Coaxial with and having larger diameter than this inner chamber is an outer chamber with straight walls and often a circumferential channel At the bottom of the second chamber are one or more apertures which allow the additive to drain into the tub of the washing machine. This type of dispenser is utilized by adding liquid additive to the inner chamber During the spin phase, centrifugal force causes the additive to flow out over the sloping walls and into the second chamber, where it continues to flow under the influence of centrifugal force into the circumferential channel. When the spin phase ends, the additive flows by gravity out of the apertures at the bottom of the second chamber and into the tub as it is filling with rinse water. Dispensers of this type are disclosed, for example, by U.S. Pat. Nos. 4,240,277 issued to Manthei; 4,186,574 issued to Sundstrom; 4,118,957 issued to Marcussen; 3,736,773, and 3,699,785 both issued to Waugh; 3,620,054 issued to Drews et al; 3,596,480 and 3,330,135 issued to Douglas; 3,481,163 issued to Bochan et al; and 4,478,059 issued to Yates. It is noted that the foregoing contemplate use with a liquid additive.

Other dispensers which utilize centrifugal force to release an additive, but which are not attached to the agitator include U.S. Pat. No. 4,379,515 issued to Towsend, which describes a free body dispenser having a balloon-like additive reservoir which releases additive under pressure generated by spin phase centrifugal forces, especially if the reservoir is sandwiched between a laundry load and the sidewall of the machine. Brenner et al, U.S. Pat. No. 4,186,573 describes a centrifugally-actuated two-chamber dispenser which hangs on the rim of the wash tub. Operation of the device of Brenner et al is similar to the agitator-mounted two-chamber dispensers, i.e., centrifugal fill of an outer chamber and gravity flow after the spin ceases.

There are numerous prior art dispensers which utilize the centrifugal force generated by the spin to effect a mechanical change in the dispenser and indirectly cause the dispensing of the additive. Clearman et al, U.S. Pat. No. 4,420,951 utilizes a dispenser apparatus mounted on an agitator which also includes a water pump and a nozzle. Under centrifugal force created by the spin, the nozzle is redirected to aim a flow of water into a portion of the dispenser containing the additives. Dugger et al, U.S. Pat. No. 4,026,131 describes a pouch containing an additive and constructed such that a seal on the pouch is broken under the centrifugal force of the spin, freeing the additive. Olthuis, U.S. Pat. No. 3,757,544 shows an agitator mounted dispenser which is held above the water level during the wash. During the spin phase the centrifugal force releases a catch on the dispenser causing it to fall below the rinse water level. McCarthy, T993,001 (US Defensive Publication) describes a spin actuated dispenser having a mass attached to a valve. Bory et al, U.S. Pat. No. 4,260,054 discloses nonsoluble sheets having partially serrated phases which rupture under spin-generated centrifugal force, releasing an additive. Merz, U.S. Pat. No. 3,888,391 discloses a dispenser which releases additive via a centrifugally actuated valve. U.S. Pat. No. 3,670,530, issued to Filipak, shows a dispenser which may be attached to the agitator and comprises a pivotable cup which pivots from vertical to horizontal during spin, pouring out the additive.

In view of the prior art, there remains a need for a mechanically simple dispenser and wash additive combination which can be used with a wide variety of commercially available washing machine agitators, and which is capable of dispensing an effective rinse-added wash additive.

It is therefore an object of the present invention to provide a centrifugally-released substrate which is added at the start of a wash cycle and is specifically adapted for release of actives into the rinse water and/or into the dryer.

It is another object of the present invention to provide a wash-added substrate capable of releasing an active having efficacy in both the rinse and in a dryer.

It is another object of the present invention to provide a wash added substrate capable of releasing a first active into the rinse and a second active into a dryer during a laundry cycle.

It is another object of the present invention to provide a wash additive combination including a dispenser and mounting means therefor adapted for use with virtually any vertical-agitator washing machine.

It is another object of the present invention to provide a means for delivery of laundry additives to a clothes washing apparatus, which means may be added prior to initiating a wash cycle and which will deliver the wash additives during a later, e.g. rinse, phase of a wash cycle.

It is a further object of the present invention to deliver a laundry additive having superior convenience and performance than those of the art.

SUMMARY OF THE INVENTION

The present invention comprises a wash additive combination and a method of use therefor which allows for the addition of a laundry additive at the start of a wash cycle and the release of actives during a rinse phase of the wash cycle (hereinafter referred to as the "rinse") The combination comprises an additive dispenser which is attached to, or which comprises, an upper surface of a washing machine agitator, and an additive packet, releasably held by the dispenser.

Preferably, the additive packet is made from a substrate comprising a thin sheet of a foam material, and has a first (folded) stable conformation and a second (unfolded) stable conformation. The folded conformation may be effected by any means known to compact a large surface area to a relatively small surface area, such as folding or rolling preferably the compaction is achieved by providing the sheet with at least one fold therein, dividing the sheet into two smaller panels, each of which has an area of one half that of the unfolded sheet The fold is in the nature of a crease, series of perforations or score line in the sheet, and stably maintains the sheet in its folded configuration, resulting in a smaller outer surface area until ejection from the dispenser, whereupon the sheet unfolds to its full outer surface area, and release of active occurs. The substrate has deposited thereon at least one wash additive composition for release in the rinse. Preferably in this embodiment there are several panels and folds for maximum active carrying and releasing capacity Regardless of the number of folds and panels, when folded, the sheet will occupy the same area of the dispenser. Optionally in this embodiment the sheet may be held together by a water releasable seal of, e.g. the additive composition itself.

A dispenser for the packet comprises, generally, a cavity defining a ramp, having a low end (relative to the wash tub) oriented closest to the center of rotation of the agitator, and an elevated end orientated closest to a periphery of the tub. Preferably, the ramp is further defined by opposing, generally vertical side walls and a rear wall, all of which aid in protecting the packet from splashing during the wash cycle, and also which aid in retaining the packet until the spin phase of the wash cycle The dispenser may be an integral part of the agitator or it may be an independent unit In a second embodiment of the present invention the packet comprises a sheet of substrate material having the first and the second stable conformations as above, and containing laundry additive actives for sequential release e.g. a softening agent for release into the rinse solution, and an antistat for release in the dryer The sequential release composition may include a single active or two or more different actives In either case, the active(s) may be formulated with an agent, e.g. a nonionic surfactant, to deliver the active at the intended point in the laundry cycle. The sequential release may also be accomplished by a variety of package designs, e.g. by laminating first the dryer additive, then the rinse additive onto the sheet of substrate material. Alternatively, spots of a heat-meltable additive may be interspersed with the rinse additive, or the sheet may be configured to have the rinse additive deposited on an outside surface and the dryer additive on an internal surface, with the sheet held together by a heat meltable seal.

The wash additive combination is used by simply placing the folded substrate into the dispenser, mounted atop the agitator During the wash phase, the substrate is retained by the dispenser and protected from the wash waters Soon after commencement of the spin phase, the substrate-is ejected by the centrifugal forces generated. Depending upon the embodiment, the substrate may unfold as it falls into the tub, it may unfold in the rinse solution, or it may partially unfold between ejection and the end of the rinse phase and fully unfold in the dryer The relatively large outer surface area of the unfolded substrate allows for rapid and complete dispersion of the active into the rinse solution when it falls into the tub. In some embodiments of the substrate, unfolding occurs upon contact with the rinse waters by, e.g. solubilizing a water-soluble seal on the packet, by the mechanical shear of the rinsing laundry, and/or by heat generated in the dryer.

It is therefore an advantage of the present invention that a wash additive may be loaded prior to the start of a wash cycle, and delivered during a later, e.g. rinse phase of the wash cycle.

It is another advantage of the present invention that the dispenser may be easily and removably mounted to virtually any type of clothes washing machine having a vertical agitator, and does not interfere with adding or removing the clothes.

It is a further advantage of the present invention that it provides a wash-added substrate capable of releasing a wash additive having efficacy in both the rinse and in a dryer.

It is another advantage of the present invention that it is capable of releasing a first active in the rinse and a second active in a dryer.

It is yet another advantage of the present invention that the consumer can easily and precisely adjust the amount of active delivered.

It is another advantage of the present invention that it combines convenience of use of wash added fabric softeners with fabric softening and antistatic performance of rinse and dryer-added softeners.

IN THE DRAWINGS

DETAILED DESCRIPTION OF THE PREFERRED EMBODIMENTS

Figure 1:
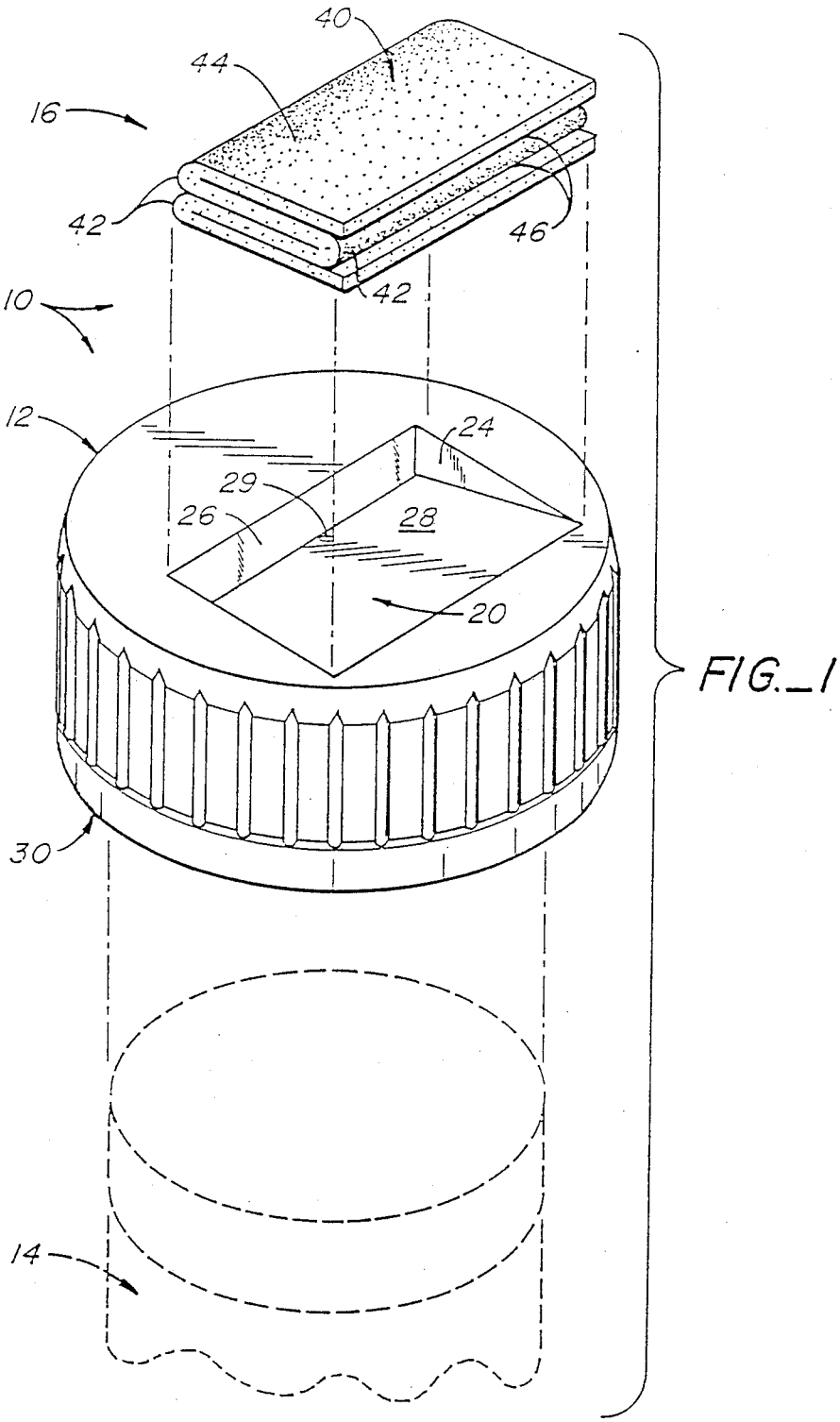
FIG. 1 is an exploded perspective view of a preferred packet and dispensing means of the present invention.
Figure 2:
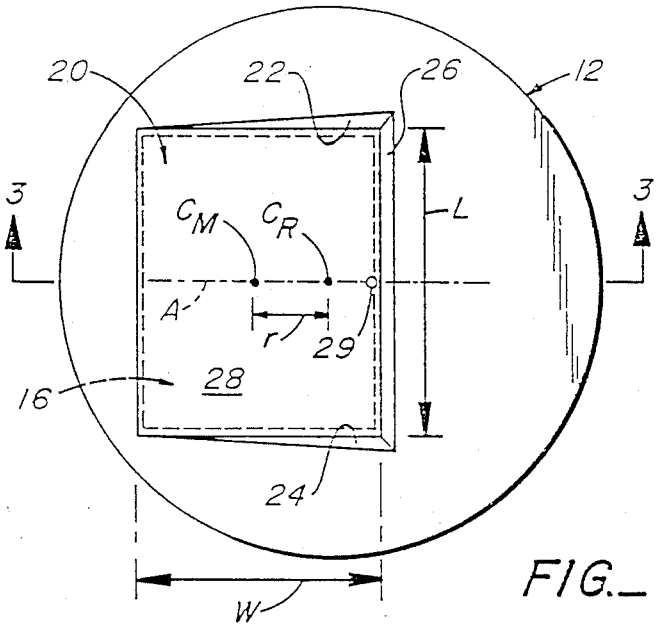
FIG. 2 is a top plan view of the dispensing means of FIG. 1.
Figure 3:
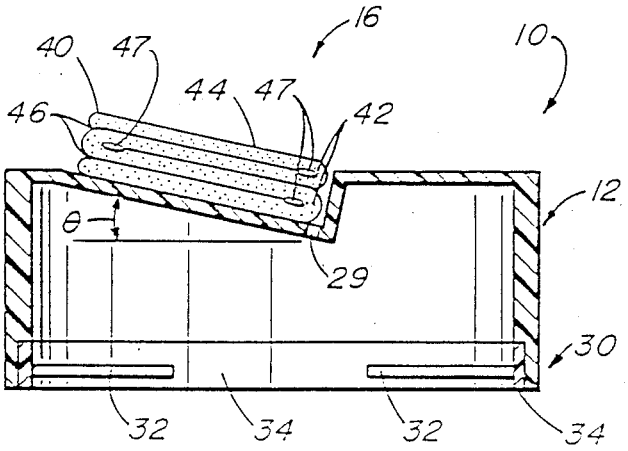
FIG. 3 is a cutaway side view, taken along with line 3—3 of FIG. 2, and also including the packet.

FIGS. 1, 2 and 3 illustrate a first embodiment of the laundry additive dispensing combination of the present invention and referred to by the general reference character 10. The combination 10 includes a dispenser 12, which may be releasably secured to, or an integral part of a vertical agitator 14, and a wash additive packet 16. The agitator 14 is driven in an oscillatory or a stepped rotary motion during a wash cycle, and rapidly rotates in conjunction with a wash tub 18 (shown in FIG. 5) during a spin phase of a wash cycle (hereinafter referred to as the "spin") The dispenser 12 is affixed to an upper surface of the agitator 14 and is adapted to release the packet 16 along a radial line A (with respect to the agitator 14) during the spin. The exact shape and dimensions of the dispenser 12 are not critical and in fact the combination 10 of the present invention is operable with a dispenser 12 comprising nothing more than a relatively flat upper surface of an agitator 14. Preferably, however, the dispenser 12 will have at least one planar inclined portion having a proximal end near a center of rotation ($C_r$) of the agitator 14 and a distal end at the periphery of the dispenser 12. The distal end is elevated with respect to the proximal end to define a ramp., The dispenser 12 must also have a stop means for retaining and locating the packet 16 on the ramp. Generally the foregoing can be effectuated by constructing the dispenser 12 to have a cup-shaped depression, thus having a central proximal end, and an elevated distal end everywhere about the periphery. Alternatively, the dispenser 12 may be constructed to have a single inclined ramp phase of a defined width, about an entire diameter of the agitator 14 such that the elevated distal end and proximal ends are diametrically opposed. Such a dispenser 12 would also include stop means near the center of rotation to retain the packet 16. Various combinations and intermediate executions of the foregoing are also acceptable. Preferably, when the dispenser 12 is not a unitary part of the agitator 14, the dispenser 12 is generally cylindrical or disk-shaped, having a cavity 20 defining a wedge, as illustrated in FIGS. 1–3. The cavity 20 includes generally congruent side walls 22 and 24, a back wall 26, defining a stop means, and a generally planar sloping floor 28. The floor 28 is inclined from the vertical by an angle $\theta$ which may range from about 1 to 45 degrees, preferably from about 7 to 26 degrees, most preferably from about 10 to 15 degrees. The greater the angle, of course, the greater the angular velocity required to dispense the packet 16. The side walls 22 and 24, and the back wall 26 are generally perpendicular to the floor 28 for ease of manufacturing. This is not critical however, and the inclination of any of the walls may vary as long as they serve to retain the packet 16. The overall shape of the cavity 20 is preferably congruent to the shape of the packet 16, except that the cavity 20 and the packet 16 cannot be shaped such that the packet 16 will not freely slide out along line A. It is therefore preferred that the packet 16 and cavity 20 be generally rectangular-shaped, as shown in FIGS. 1 and 2. The most preferred embodiment of the dispenser 12 has cavity 20 dimensions of about $3\frac{1}{4}'' \times 2'' \times \frac{1}{2}''$. Generally, the data show that dispensing repeatability is best with the cavity 20 and packet 16 oriented so that their longest axes (L) are perpendicular to the line of release A, and their shorter axes (W) are parallel to line A. It is also important to the practice of the present invention that there be a slight clearance between the length of the packet 16 and the distance L between the side walls 22 and 24, generally between about one eighth to one quarter of an inch. Expressed alternatively, the distance L from wall 22 and wall 24 should be about one hundred and one to one hundred and eight percent of the the length of the packet 16. The coefficient of friction between the substrate packet 16 and the floor 28 of the dispenser 12 should be such that there is a restraining relationship between the dispenser 12 and packet 16 during the wash phase. Generally, the packet 16 should not slide so freely that any rotary motion of the agitator 14 will eject it during the wash phase, nor should it be retained so strongly that it will not eject during the spin phase of the wash cycle. The restraining relationship between the floor 28 and the packet 16, may vary depending on the angle $\theta$ and the spin radius (r) of the packet 16. The spin radius of the packet 16 is the distance (or offset) from $C_r$ of the agitator 14 to a center of mass ($C_m$) of the packet 16, and together with the angular velocity of the agitator 14, defines the agitator speed needed for dispensing. It is readily apparent that the spin radius must be greater than zero to ensure successful dispensing, as a $C_m$ coincident with the $C_r$ would yield no net force applied to the packet 16 along line A. Thus the lower limit of r is a value greater than 0, and r may be 3 to 4 inches depending on the size of the dispenser 12. Preferably, the spin radius should be about one quarter inch to two inches. In a most preferred embodiment utilizing the dispenser 12 having the wedge-shaped cavity 20 with the long axis (L) perpendicular to the dispensing line A, the spin radius should be about one quarter inch to one and one half inches, more preferably one half to three-quarters of an inch. Preferably the packet 16 should be ejected from the dispenser 12 at an agitator speed of between about 200 to 400 rpm, most preferably between about 250–300 rpm. Equation I defines the function of the spin radius and angle $\theta$ as they relate to the agitator dispensing speed for the packet 16.

$$\omega = \sqrt{\frac{g}{r} \tan \theta} \qquad \text{Equation I}$$

wherein $\omega$=angular velocity; g=acceleration of gravity and r=spin radius of the packet 16, in cm.

If constructed as an independent unit, the dispenser 12 may be made of a variety of water-resistant materials, such as plastics, metals, natural fibers etc., and in the most preferred embodiment, the dispenser 12 is a unitary thermoformed or injection molded plastic, with the cavity 20 molded or formed therein While the cavity 20 generally prevents the wash waters from contacting the packet 16 during the wash phase, some splashing may occur with large loads and vigorous agitation. For this eventuality, it is preferred that there be at least one drain aperture 29 formed through the floor 28 to allow any water falling into the cavity 20 to drain out.

Figure 4:
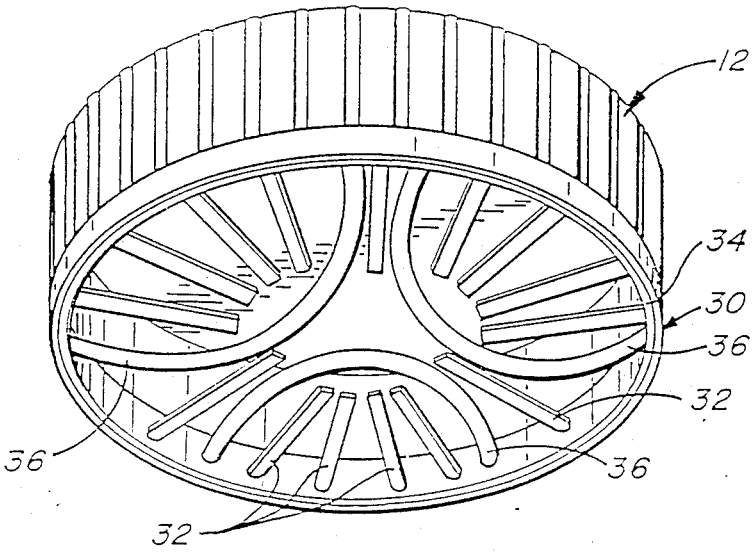
FIG. 4 is a bottom perspective view, showing a preferred embodiment of the securing means of the dispenser of FIGS. 1–3.

The dispenser 12 is secured to the agitator 14 by a securing means 30. The securing means 30 may be an integral part of the dispenser 12, formed, for example, by molding, or it may be attached to the dispenser 12 by any means known in the art, e.g., adhesives, frictional engagement or mechanical fastening. The securing means 30 must be adapted to position the dispenser 12 such that the angle and the $C_m$ of the packet 16 remain within their required ranges, and should position the dispenser 12 so there will be adequate clearance in the typically limited headspace between the top of the agitator 14 and the machine lid (not shown). The most preferred embodiment of the securing means 30 is illustrated in FIG. 4, and acts to both attach and center the dispenser 12 about the agitator 14. The most preferred securing means 30 includes a plurality of flexible fingers 32, radially inwardly arrayed about a cylinder 34 which may be a part of, or attached to the dispenser 12. Also projecting partially inward are at least three centering loops 36, spaced equidistantly from each other about an inner periphery of the cylinder 34. The centering loops 36 act primarily to center, and secondarily to secure, the dispenser 12 to the agitator 14, while the fingers 32 act principally to secure, and secondarily to center. The loops 36 are designed to project radially inward slightly more than the fingers 32, to a distance of about two-thirds of a radius of the cylinder 34. Also because the loops 36 are secured at both ends to the cylinder 34, they are less resilient than the fingers 32. These qualities result in the loops 36 engaging the agitator 14 about a higher phase than that which is engaged by the fingers 32, yielding a firmer, more stable support for the dispenser 12. Both the fingers 32 and loops 36 are made of a resilient plastic material, preferably an ethylene vinyl acetate (EVA) copolymer, a low density polyethylene (LDPE), or a blend of LDPE and EVA. Most preferably the fingers 32, loops 36 and cylinder 34 are formed as a unit, and the cylinder 34 may be frictionally fitted within an inner, lower periphery of the dispenser 12, as shown in FIG. 3. This aids in manufacturing, as the dispenser 12 can be made from a material having the desired coefficient of friction with the packet 16, while the securing means 30 can be made to have the desired resiliency. While the foregoing is the most preferred securing means 30, other securing means known in the art such as adhesives, mechanical means or elastic means can also secure the dispenser 12- to the agitator 14. Either the fingers 32, or the centering loops 36 may be used alone as the securing means 30, although this may require more manual adjustment to correctly position the dispenser 12.

Figure 5:
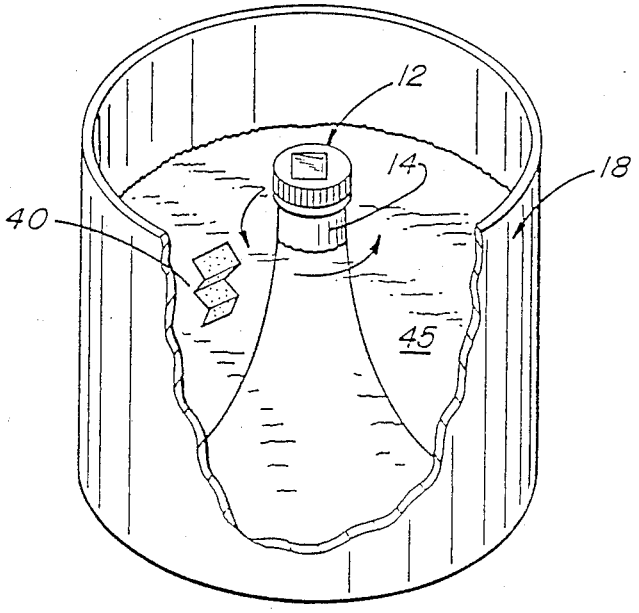
FIG. 5 is a perspective view of the packet and dispensing means of FIG. 1, showing release of the packet into a rinse solution.

The packet 16 comprises a substrate material 40 having a first and a second stable conformation wherein the first, conformation has a smaller outer surface area than the second conformation. Preferably this is effectuated by overlapping layers of a sheet of the substrate material 40, e.g. as by folding or rolling, to result in a compact package. In terms of outer surface area, the first conformation should have a surface area of no more than about 90% of the area of the second conformation, more preferably 50% and most preferably 25%. The reduction in outer surface area may also be accomplished by compressing a volume of a lightweight foam material into suitable dimensions. The substrate 40 is most preferably in the form of a sheet, and is impregnated with an additive composition preferably, the substrate 40 is a urethane or polyethylene foam material Most preferably, the foam is a closed cell type, although open cell foams are also suitable. The closed cell foam results in active being deposited over a greater substrate area which advantageously acts to increase active dispersibility in the rinse solution and in the dryer, resulting in better performance. The sheet of substrate 40 preferably has a thickness of about one-eighth of an inch, and a weight of about 1 g, and has unfolded dimensions of about 3"−8"−⅛" and folded dimensions of 3"−2"−½". In its unfolded configuration, the sheet of foam material is preferably an elongated rectangle, as shown in FIG. 5, and includes a plurality of folds 42 defining a release means, which may be creases, a series of perforations, or score lines in the sheet, transversely placed along the sheet to divide the sheet into generally congruent panels 44. For ease of manufacturing, it is preferred that each of the panels 44 of the sheet 40 have the same length (L) and width (W), as shown in FIG. 2. Preferably, when there are more than two panels 44, the folds 42 alternate in direction of fold, i.e. they are above and below on opposing planar surfaces of the sheet so that the sheet remains stably folded in accordion-like manner under its own weight. The folds 42 may also be all on the same surface of the sheet, if, e.g. there are no more than about four panels 44. The folds 42 are formed into the substrate 40 such that the substrate 40 will stably remain in its first or folded configuration, as shown in FIGS. 2-3, when retained within the cavity 20 of the dispenser 12. When urged out of the cavity 20 by the centrifugal forces generated by the spinning agitator 14, the substrate 40 of the packet 16 will unfold in an aqueous rinse solution 45, as shown in FIG. 5, to provide a large outer surface area for release of the active. The sheet will then stably remain in the second, or unfolded configuration for the remainder of the laundry cycle. The large outer surface area of the unfolded sheet of substrate 40 also provides the added benefit of not interfering with the normal venting in the dryer. Most preferably, the folds 42 are defined by score lines or a series of perforations, which not only provide for the folding of the sheet of substrate material 40 but allow the consumer to tear off a strip of the substrate 40 from a continuous roll. This affords the consumer a convient and accurate way of adjusting the amount of active which will be delivered, and simplifies manufacturing of the substrate 40. The dimensions of the substrate 40 are not critical, although there must be a sufficient outer surface area to retain a softening-effective amount of softener composition, and the substrate 40 should not be of a shape which would preclude dispensing. A preferred outer surface area is about 20–200 square inches, more preferred is about 25–100 sq. in., and most preferred is about 25–60 sq. in. Also, the packet 16 (including sheet 40 and the composition) must possess sufficient mass to ensure its retention during the wash phase and ejection from the dispenser 12 during the spin phase of the wash cycle. In the preferred embodiment of the packet 16, the folds alternate above and below the plane of the sheet so that the sheet will fully open when immersed in the rinse solution 45. When the folds 42 are above and below the plane of the sheet of substrate material 40, between each resulting panel 44 there is a gap 46, shown in FIGS. 1 and 3, through which water may enter the interior of the folded packet 16. It has been found that entry of water through the gaps 46 assures unfolding of the packet 16 early in the rinse phase. This configuration of the substrate 40 also provides for sequential unfolding of each panel 44 of the substrate 40, without requiring that the packet 16 change its orientation in the water and without depending on the unfolding of previous panels 44. It is also within the scope of the invention herein to make the substrate 40 of a water-soluble material, which would dissolve in the rinse solution, after dispersion of active.

An alternative to overlapping thin layers of a sheet of substrate to achieve a compact package is to utilize a block of a lightweight low-density foam material and compress it to the same dimensions as the folded sheet of substrate material 40, i.e. about 3"×2"×½". Such a block would preferably have uncompressed dimensions of about 5×5×2 inches to yield an outer surface area of about 50 square inches, and a comparable active-carrying capacity to the sheet The block would be impregnated with the laundry additive and compressed to about ¼"to 1"in height, by any means known in the art wherein the additive would maintain the block in the compressed state. Optionally a water-soluble band could be employed as the release means to ensure retention of the compression until immersed Any of the foregoing configurations will result in the packet 16 capable of operating in accordance with the teachings herein, and all such configurations are within the scope of the present invention.

A most preferred embodiment of the packet 16 includes the sheet of substrate material 40 having dimensions as described above, a plurality of Z folds 42 and further includes edge seals 47 to seal each fold 42. The edge seals 47 are water-soluble so that the packet 16 will unfold only upon entering the water This is preferable as it ensures that the packet 16 will be ejected in its folded state from the dispenser 12 and will not stick to the wash tub 18 above the water level. While virtually any water soluble material can be used for the edge seals 47, it is preferred to simply apply heat to the edges of the folded panels 44 along the folds 42 to melt a portion of the fabric softening active, thus providing a water-soluble seal of the desired strength without requiring additional components.

In an alternative embodiment of the packet 16 cf the present invention, there is provided a plurality of sheets of substrate material 40 of a woven or nonwoven fabric material, folded into a compact configuration to fit within the cavity 20, and held together by a water-soluble seal. The water-soluble seal may comprise, for example, a band of polyvinyl alcohol, a polysaccharide, cellulose or similar materials. These or similar materials may also be used as an adhesive to secure the sheets The sheets further may be held together by an insoluble means, e.g by a stitch about one axis, to allow expansion to the maximum surface area without resulting in dispersion of the individual sheets in the rinse solution. Any of the foregoing sealing means may also be used with the sheet of foam substrate material 40 of the preferred embodiment, or a plurality of sheets of substrate 40, with or without the folds 42 In all other respects, this embodiment is identical with the first embodiment.

A second embodiment of the present invention is adapted to release a first active in the rinse and a second active in the dryer, and comprises a packet 16 carrying two actives for the sequential, dual release. For example, the sheet of substrate material 40 may have the actives applied in layers for sequential release. Thus, the dryer-release active, typically an antistat, would be applied directly to the substrate 40, and the rinse-release active, typically a softener, would be laminated onto the antistat. The packet 16, in all other respects, is as described in the first embodiment, and is used with any of the previously described dispensers 12. Alternatively, the packet 16 may be formulated with the addition of discrete dots of antistat distributed over all or part of the sheet 40. A further implementation of the packet 16 is to fold and seal it with a heat-releasable seal which will not release in the rinse solution, but, upon encountering the elevated temperature of the dryer will melt to allow the packet 16 to unfold to its fullest surface area. Preferably in this embodiment, the softening composition is formulated and applied such that predominately softening agent is released in the rinse, and predominately antistatic agent is released in the dryer. This could be done, for example by applying softening agent to be on the outside of the packet 16 when folded, and by applying antistatic agent to be on those surfaces of the packet 16 which are exposed when unfolded In any of the foregoing embodiments of the packet 16, the active material is deposited onto the sheets 40 by any means known in the art, preferably by impregnation or lamination. It has also been determined that in situ foam production i.e., forming the foam with active, allows for high levels of active, which, in turn, allows for continued release in the dryer of active such that antistatic activity and some softening occurs in the dryer.

FABRIC SOFTENER

The cationic fabric softener compounds of the present invention are preferably quaternary ammonium or imidazolinium compounds having at least one quaternary nitrogen atom in the molecule. The quaternary ammonium compounds are exemplified by the following structure:

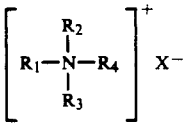

wherein $R_1$ and $R_2$ are the same or different, and are long chain saturated or unsaturated aliphatic hydrocarbon groups each with from 14 to 26 and preferably 16 to 20 carbon atoms, and wherein $X^-$ is halide, nitrate, sulfate, methylsulfate or ethylsulfate. Preferably, $X^-$ is halide or methylsulfate, most preferably chloride or bromide. The remaining two groups ($R_3$ and $R_4$) may be $C_{1-6}$ alkyl and/or hydroxy alkyl in which the alkyl portion thereof can be straight or branched Optionally, the hydroxy alkyl groups can include from 1 to 6 moles of ethylene oxide The long chain aliphatic carbon groups can be linear or branched and derived from fatty acids or fatty amines. Examples of such quaternary ammonium fabric softeners include distearyl dimethylammonium chloride, ditallow dimethylammonium chloride, dioleyl dimethylammonium chloride, ditallow methylhydroxy ethylammonium chloride, ditallow methylhydroxypropyl ammonium chloride and dimyristyl diethyl ammonium bromide. Most preferably, the $R_1$ and $R_2$ groups are derived from tallow or hydrogenated tallow and the $R_3$ and $R_4$ groups are methyls Also useful are diquats having the following structure:

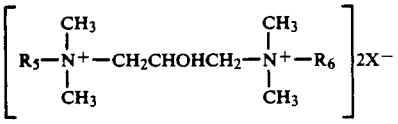

wherein $R_5$ and $R_6$ are the same or different and are $C_{14-20}$ alkyl or alkenyl Examples of diquats include JORDAQUAT DIMER 18, and JORDAQUAT DIMER AD trademarked products of the Jordan Chemical Co. Other useful fabric softeners include the imidazolinium-type exemplified by the following structure:

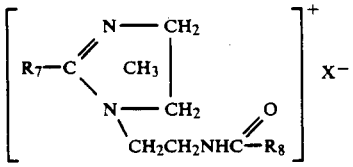

wherein $R_7$ and $R_8$ are the same or different and are selected from the group consisting of $C_{12-22}$ alkyl and alkenyl groups and wherein $X^-$ is halide, nitrate, sulfate, methylsulfate or ethylsulfate. Preferably, $X^-$ is halide or ethylsulfate, most preferably chloride or bromide. Exemplary compounds of this type include 1 methyl-1-alkylamidoethyl 1-2-alkylimidazolinium methylsulfate. An example of this compound is manufactured and marketed by the Sherex Chemical Co., Inc., under the Trademark VARISOFT 3690, wherein the alkyls are derived from oleic acid. Also suitable is VARISOFT 222/LT, a methyl bis (oleylamidoethyl) 2-hydroxyethyl ammonium methyl sulfate. Mixtures of any of the foregoing fabric softeners are also suitable. A preferred weight average molecular weight range is between about 400 and 1000 g/mole, more preferred is between about 600 and 800 g/mole. The fabric softener will be present in a fabric softening-effective amount, and preferably from about 30 to 100 weight percent of the total composition added to the substrate, or between about 25 to 85 weight percent of the total weight of the packet 16. Most preferably the fabric softener comprises about 90% of the total composition added to the substrate, or about 75% of the total weight of the packet 16. Thus about 0.5 to 60 g, and preferably 1–10 g, of fabric softener active is deposited onto the substrate Other fabric softener actives are known in the art and are suitable for use with the present invention. These include, for example, alkyl and cyclic amines, and salts thereof, such as those disclosed in U.S. Pat. Nos. 4,661,269 issued to Trinh et al, and 4,661,267 issued to Dekker et al, and substituted amine salts, disclosed in U. S. Pat. No. 4,139,479 issued to Goffinet, the disclosures of which are incorporated herein by reference.

The foregoing compounds can function both in the rinse as fabric softener and in the dryer as the antistat, and a single compound may play both roles. The fabric softening composition is usually formulated to include a dispersing agent for maximum substantivity in the rinse solution.

DISPERSING AGENT

A surfactant, preferably a nonionic surfactant, may be present with the fabric softening material to ensure its dispersal from the substrate at the appropriate point in the laundry cycle. Generally, the dispersing agent is hydrophilic, i.e. water-soluble/dispersible or hydrophobic, i.e. water-insoluble but is heat meltable. The former dispersants may be combined with the fabric softening active to provide for release in the rinse, while the latter may be combined with the same or different active to survive the rinse and release in the dryer. Release in the dryer generally requires a dispersing agent which lowers the melting point of the active to below the dryer operating temperature. Generally the water-soluble/-dispersible surfactants will have an HLB value of about 7–19, while the non water-soluble and/or heat-meltable surfactants will range from about 3–11, although HLB alone is not determinative of a surfactant's usefulness. Examples of water-soluble/dispersible agents include the nonionic surfactants, and preferred are the ethoxylated alkyl phenols, particularly those with an average chain length of 8–16 carbons and 2–20 moles of ethylene oxide per mole of alcohol. More preferred is a nonyl phenol with 9–10 moles of ethylene oxide per mole of alcohol, such as Rohm and Haas' trademarked TRITON series, especially TRITON N101. It has been surprisingly found that a $C_{12}$ alkyl phenoxypoly (ethyleneoxy) ethanol, having an average of ten to twelve moles of ethylene oxide per mole of alcohol, dramatically increases dispersion of the fabric softener from and through the foam substrate. Ethoxylated alkyl phenols are also available from the GAF Corporation under the Trademark IGEPAL. Other suitable hydrophilic surfactants include linear or branched primary and secondary ethoxylated alcohols, with an average chain length of 6–18 carbons, and having about 2–10 moles of ethylene oxide per mole of alcohol. Also preferred are sorbitan monoesters, especially those esterfied with 12–18 carbon acids and having about 3–20 moles of ethylene oxide per mole of ester. Examples include TWEEN 21, a trademarked product of ICI Americas, Inc., comprising a lauric acid ester with four moles of ethylene oxide per molecule. Particularly good at dispersing an active, e.g. a fabric softener in the rinse are liquid surfactants such as GAF Corporation's trademarked IGEPAL DM-710 (an ethoxylated alkyl phenol), IGEPAL RC-630, which is a C12 ethoxylated alkyl phenol having twelve ethoxy groups per mole of alcohol and KATAPOL PN-730 (a polyoxyethylated tallow amine). Water insoluble agents may also comprise nonionic surfactants such as tallow alcohols and fatty acid esters, especially sorbitan tri-esters and soaps. Other water-insoluble dispersants include waxes and $C_{1-18}$ alkyl amines. A single dispersing agent may be both water-soluble and heat meltable and may be combined with the same or different active for dual delivery into the rinse and the dryer. An example of such an agent is ICI America' trademarked TWEEN 65, a sorbitan tristearate having about 20 ethoxy groups per molecule. Some commercially available fabric softener formulations are sold with small amounts of a surfactant already present. The dispersing agent described herein may thus be endogenous to the softener, or may be added separately. The amount of dispersing agent present on the substrate 40 is about 0 to 10 grams, preferably about 1–6 grams.

OTHER COMPOUNDS

In addition to, or instead of the fabric softening active, various other components can be carried on the substrate 40 for delivery into the rinse and/or dryer. These include starches, bleaches, brighteners, anti-wrinkling agents, odor control agents, fabric mildewstats such as those disclosed in copending U. S. application serial number 090,195, (filed Aug. 26, 1987 and assigned to the same assignee as the invention herein) anti-staining agents and soil release-agents. Particularly advantageous soil release agents include polyesters such as those described in U. S. Pat. No. 3,711,730 issued to Gosselink et al. the disclosure of which is incorporated herein by reference. Fragrances often comprising esters of long chain alcohols, may be added to the composition, and can additionally act as dispersing agents for the actives. Generally, no more than about 1–5 of fragrances are added. Levels of these components added will be dictated by the the type and intended function of the component and the type and size of the substrate 40. Generally, utilizing the most preferred substrate 40 described herein, about 0–6 g of such other components (in addition to the fabric softener/antistat) are included. If an active other than a fabric softener/antistat is to be the sole or principal active it is added at levels comparable to those of the softener/antistat, i.e from about 0.5 to 60 g.

METHOD OF USE

To use the wash additive combination 10, the dispenser 12 is affixed by the securing means 30 to the agitator 14 (unless formed integrally therein) about an upper phase thereof, which is high enough to avoid immersing any phase of the dispenser 12 in the wash liquid The walls 22, 24 and 26 act to protect the packet 16 from splashing of the wash water, although an appreciable quantity of softening composition would be retained on the sheet 40 even if splashing does occur. The packet 16 is dropped into the cavity 20 at the start of the wash cycle, and held thereby within the dispenser 12 during the slow oscillatory or rotary motion of the agitator 14. At the end of the wash phase the high speed spin phase commences. Sufficient centrifugal force will be rapidly built up to cause the packet 16 to slide along line A from the floor 28 of the cavity 20, thence into the wash tub 18, whereupon the substrate 40 unfolds and releases the active. Advantageously, release of the rinse actives from the packet 16 does not begin until the packet 16 is substantially immersed in the rinse solution 45 subsequent to the evacuation of the wash waters. Upon filling of the tub 18 with such rinse solution 45, the substrate 40 unfolds to its fullest extent and greatest outer surface area for rapid and complete release of active. If desired, the packet 16 is then transferred with the clothes to the dryer whereupon the additional active is released due to the elevated temperature therein.

EXPERIMENTAL RESULTS

Softening performance and static cling reduction were evaluated and reported in Tables 1 and 2 respectively. In both cases the additive packed comprised a substrate of a closed cell foam having unfolded dimensions of about 3"×8"×⅛". The sheet was folded 3 times to yield folded dimensions of 3"×2"×½". The active comprised a dihydrogenated tallow dimethyl ammonium chloride fabric softener plus dispersant and fragrance, in various amounts as shown.

Softening was evaluated by trained softening panelists using a scale of 0–60 points. Static cling reduction was evaluated by trained observers using a scale of 0 to 4 (0 =no cling, crackle or static while 4 =heavy cling, crackle and static.) The wash medium in both cases was TIDE detergent (a trademarked product of Procter and Gamble).

TABLE 1

| Treatment | Result |
|---|---|
| DOWNY[1](80 g product) | 50.2 |
| BOUNCE[1](1 sheet) | 29.3 |
| SNUGGLE[2](80 g product) | 48.1 |
| CLING FREE[3](1 sheet) | 22.9 |
| Present Invention (2.6 g active) | 36.8 |
| Present Invention (4.6 g active) | 48.4 |

[1]a trademarked product of the Procter & Gamble Co.
[2]a trademarked product of Lever Brothers, Inc.
[3]a trademarked product of Beecham Products, Division of Beecham, Inc.

The values scored by SNUGGLE, and by the Present Invention having 4.6 g active are not statistically significantly different from those of DOWNY at the 95% confidence level. The value scored by the Present Invention having 2.6 g active is not significantly different from those of DOWNY or SNUGGLE at the 99% confidence level.

TABLE 2

| Treatment | Score |
|---|---|
| DOWNY[1](80 g Product) | 0 |
| BOUNCE[1](1 sheet) | 0 |
| SNUGGLE[2](80 g product) | 0 |
| CLING FREE[3](1 sheet) | 0 |
| Present Invention (2.6 g active) | 1 |
| Present Invention (4.6 g active) | 0 |
| TIDE only | 3 |

[1]a trademarked product of the Procter & Gamble Co.
[2]a trademarked product of Lever Brothers, Inc.
[3]a trademarked product of Beecham Products, Division of Beecham, Inc.

Table 3 shows softening performance of the article of the present invention under actual usage conditions wherein the packet is added to the washer prior to the start of the wash cycle, releases active in the rinse and is then transferred to the dryer to release additional active. All washes were TIDE washes. Results are scored as for Table 1. Trials 2 and 4 are not statistically significantly different from trial 1 at the 95% confidence level.

TABLE 3

| Trial | Rinse Cycle | Dryer | Results |
|---|---|---|---|
| 1 | DOWNY (80 g product)[1] | nothing | 45.5 |
| 2 | Present Invention | nothing | 41.4 |
| 3 | nothing | sheet from #2 | 14.7 |
| 4 | Present Invention | Present Invention | 41.0 |
| 5 | nothing | new Present Invention packet | 36.1 |
| 6 | nothing | BOUNCE (1 sheet)[1] | 26.9 |
| 7 | TIDE[1]only | | 6.5 |

[1]a trademarked product of the Procter and Gamble Co.

A comparison of Trial 4 with Trials 1 and 6 of Table 3 demonstrates that the packet of the present invention provides softening performance equal to a leading rinse-added liquid and superior to a leading dryer-added sheet. Trials 2 and 5 show the effectiveness of the packet when originally added either to the rinse or to the dryer Trial 3 shows that a significant amount of active remains available even after dispersion in the rinse.

Table 4 shows the effect of spin radius and angle of the dispensing cavity 20 on dispensing speed. The data were obtained utilizing a spin test device allowing precise rpm measurements, and a dispenser substantially as described for the preferred embodiment and illustrated in FIGS. 1-5. The dispenser was removably secured to the spin tester with an adhesive to achieve the various spin radius and angles tested. Ten runs were done at each setting, and an average rpm dispensing speed is reported in the table.

TABLE 4

| Spin Radius (Inches) | Dispensing Speed (rpm) Angle 7° | 15° | 25° |
|---|---|---|---|
| 0 | — | 281 | — |
| .25 | 211 | 223 | 295 |
| .50 | 190 | 206 | 265 |
| .75 | 173 | 186 | 227 |

As demonstrated by the foregoing, an angle between 7 and 25° and spin radius of about 0.25–0.75 inches provide repeatable dispensing.

Table 5 illustrates the effect of the spin radius on repeatability of dispensing of the present invention with various commercially available clothes washing machines, and at various fabric (agitation) settings. In all cases the dispenser was substantially as described in the preferred embodiment, having dispensing cavity dimensions of about $3\frac{1}{4}''\times\frac{1}{2}''\times 2''$, and an angle $\frac{1}{2}$ of 15°. The packet 16 was a closed cell foam weighing about 6 g total and containing about 5 g of active. The packet had folded dimensions of $3''\times 2''\times\frac{1}{2}''$, and unfolded dimensions of $3''\times 8''\times\frac{1}{8}''$. The notation "A " in the table indicates a successful dispensing rate of 100% (at least 3 repetitions), and a "B" indicates a dispensing rate of less than 100%.

TABLE 5

| Brand | Cycle setting | Spin Radius (inches) | Result |
|---|---|---|---|
| GE | Regular | .75 | A |
| GE | Delicate | .75 | A |
| GE | Regular | .50 | A |
| GE | Delicate | .50 | A |
| GE | Regular | .25 | A |
| GE | Delicate | .25 | A |
| K | Cotton | .75 | B |
| K | Perm. press | .75 | B |
| K | Delicate | .75 | A |
| K | Cotton | .50 | A |
| K | Perm. pres | .50 | A |
| K | Delicate | .50 | A |
| K | Cotton | .25 | A |
| K | Perm. press | .25 | A |
| K | Delicate | .25 | A |
| W | Regular/heavy | .75 | A |
| W | Knits/gentle | .75 | A |
| W | Regular/heavy | .50 | A |
| W | Knits/gentle | .50 | A |
| W | Regular/heavy | .25 | A |
| W | Knits/gentle | .25 | B |
| M | Regular | .75 | A |
| M | Delicate | .75 | A |
| M | Regular | .50 | A |
| M | Delicate | .50 | A |
| M | Regular , | .25 | B |
| M | Delicate | .25 | B |

GE =General Electric SPOTSCRUBBER TM
K =Kenmore 70 SERIES TM
W =Whirlpool IMPERIAL 70 TM
M =Maytag FABRIC MATIC TM While described in terms of the presently preferred embodiments, it is to be understood that such disclosure is not to be interpreted as limiting. Various modifications and alterations will no doubt occur to one skilled in the art after having read the above disclosure. Accordingly, it is intended that the appended claims be interpreted as covering all alterations and modifications as fall within the true spirit and scope of the invention.

We claim:

1. A method for introducing a rinse additive to a rinse phase of a fabric washing machine without interrupting a wash cycle thereof, the method comprising (a) releasably placing about an upper portion of an agitator of a washing machine, prior to initiating a wash cycle, a wash additive packet, such that a center of mass of the packet is offset from a center of rotation of said agitator, the packet comprising a flexible substrate material, having a first stable conformation of a first outer surface area, and a second stable conformation of a second outer surface area, said second outer surface area being greater than said first outer surface area, the substrate having deposited thereon a dispersible wash additive for dispersion in an aqueous rinse solution;

(b) placing the substrate into said first stable conformation and placing said wash additive packet about said upper portion of said agitator prior to initiating said machine wash cycle;

(c) releasing the additive packet from said upper portion of said agitator into a surrounding wash tub, under centrifugal forces generated by a spin phase of said wash cycle; and (d) adding said aqueous rinse solution to said wash tub whereby, the packet will attain said second stable conformation in, and release said additive into, said rinse solution.

2. The method of claim 1 and further including the step of affixing a wash additive dispenser to said agitator, the dispenser including a securing means for mounting about said agitator and being adapted to support and retain the additive packet during said wash phase and to release the packet during said spin phase, the dispenser including at least an inclined ramp portion defing a cavity wherein the additive packet may be retained such that said center of mass is offset from said center of rotation by about one quarter to two inches, and wherein the packet will be ejected at an agitator speed of about 200–400 rpm.

3. The method of claim 1 wherein the flexible substrate material is a sheet of a closed cell foam and has at least two folds therein, alternating above and below a plane of the sheet such that when folded into the first stable conformation, the sheet describes a "Z" shape, the folds being positioned to divide the sheet into at least three generally congruent panels; and the sheet includes an edge seal means of secure at least a portion of each panel to an adjacent panel, the seal means being water-soluble to allow unfolding to the second stable conformation upon contact with water.

* * * * *